US009261339B2

(12) United States Patent
Mancini et al.

(10) Patent No.: US 9,261,339 B2
(45) Date of Patent: Feb. 16, 2016

(54) MULTIPLE REPORT STUN GRENADE

(71) Applicant: CSI-Penn Arms, LLC, Jamestown, PA (US)

(72) Inventors: Patrick Mancini, Corona, CA (US); Brian Vuksanovich, Poland, OH (US)

(73) Assignee: CSI-PENN ARMS, LLC, Jamestown, PA (US)

( * ) Notice: Subject to any disclaimer, the term of this patent is extended or adjusted under 35 U.S.C. 154(b) by 0 days.

(21) Appl. No.: 14/547,383

(22) Filed: Nov. 19, 2014

(65) Prior Publication Data

US 2015/0285602 A1 Oct. 8, 2015

Related U.S. Application Data

(60) Provisional application No. 61/907,468, filed on Nov. 22, 2013.

(51) Int. Cl.
*F42B 8/00* (2006.01)
*F42B 12/42* (2006.01)
*F42B 27/00* (2006.01)

(52) U.S. Cl.
CPC ..... *F42B 12/42* (2013.01); *F42B 27/00* (2013.01)

(58) Field of Classification Search
USPC ..... 102/360, 499, 482, 487, 498
See application file for complete search history.

(56) References Cited

U.S. PATENT DOCUMENTS

| | | | | |
|---|---|---|---|---|
| 5,654,523 | A | 8/1997 | Brunn | |
| 6,595,139 | B1 * | 7/2003 | Haeselich | F42B 12/46 102/368 |
| 7,963,227 | B1 | 6/2011 | Brunn | |
| 8,365,668 | B2 * | 2/2013 | Brunn | F42B 27/00 102/364 |
| 9,103,638 | B2 * | 8/2015 | Thomas | F42B 12/36 |

* cited by examiner

*Primary Examiner* — J. Woodrow Eldred
(74) *Attorney, Agent, or Firm* — Bennet K. Langlotz; Langlotz Patent & Trademark Works, Inc.

(57) ABSTRACT

Multiple report stun grenades have an elongated body defining a body axis and having a sidewall and opposed top and bottom end faces, the body including a plurality of delay chambers each containing a different delay feature, the body having a plurality of flash charge chambers each containing a quantity of flash charge material, the body defining a plurality of ignition passages, each ignition passage communicating from a respective flash charge chamber to an associated delay chamber, each flash charge chamber having at least one exhaust aperture, and each of the exhaust apertures penetrating at least one of the top and bottom end faces. Each of the flash charge chambers may have a first exhaust aperture penetrating the top end face, and a second exhaust aperture penetrating the bottom end face. Each of the flash charge chambers may be an elongated bore parallel to the body axis.

18 Claims, 5 Drawing Sheets

MULTIPLE REPORT STUN GRENADE

CROSS-REFERENCE TO RELATED APPLICATION

This application claims the benefit of U.S. Provisional Patent Application No. 61/907,468 filed on Nov. 22, 2013, entitled "MULTI-BANG GRENADE," which is hereby incorporated by reference in its entirety for all that is taught and disclosed therein.

FIELD OF THE INVENTION

This invention relates to stun grenades employed by law enforcement and military as distraction devices.

BACKGROUND OF THE INVENTION

Stun grenades, or "flash-bang" devices are used by military and law enforcement as non-lethal devices intended to distract or stun dangerous suspects or adversaries. Such devices are deployed to minimize hostile responses, and to generate compliance.

A typical existing device employs a "single bang" provided by a quantity of flash-charge material (such as a mixture of aluminum powder and potassium perchlorate) that is detonated after a brief delay. A fuse is activated by release of a handle as in a typical grenade, and the fuse ignites a column of delay material (such as black powder or Zirconium Nickel). The column provides a delay (typically ½ second) until the flame front in the delay material reaches an aperture that communicates with the flash-charge material, igniting it to provide a bright flash and loud report.

One such device is shown in U.S. Pat. No. 5,654,523 to Brunn, titled "Stun Grenade."This "single-bang" device has an advantageous configuration. Like many others, it is a cylindrical body sized to readily be gripped by an adult hand, so that the device is secure in the user's fist, with the ends of the cylinder protruding beyond each end of the user's fist. The disclosed device has the advantage that all the vent holes for releasing the energy of the flash charge material come out the ends of the grenade body. While a device normally discharges only after a delay following release by the user, there is a remote possibility that the grenade may discharge while still in the user's hand, such as if the user is distracted, or the device snags on the user's glove. The disclosed device minimizes the risk of serious injury in such an event by discharging the combustion gases out the ends of the device, with no apertures in the cylindrical sidewall of the device.

Other devices have sought to provide added tactical effectiveness by employing a device with multiple reports in a single grenade. Such a device is shown in U.S. Pat. No. 7,963,227 to Brunn, titled "Multiple Report Stun Grenade." This device provides a timed sequence of activating flash charges by positioning passages at different locations along a central column. Upon discharge, gases and materials escape from openings at both ends of sleeves so the motive forces generated by expelled gases will be balanced. The Brunn '227 device has the disadvantages of being complex and expensive to manufacture. The Brunn '227 device is also potentially vulnerable to having cross-contamination of pressure gradients causing sympathetic communication between explosion events. Unexpected charge initiation events can also be caused by issues with flame communication from the center delay column to the charge tubes. The center delay column is wide and the burn front is uncontrolled as it progresses. Because the tubes that communicate the flame to the charge tubes are closer together than the possible flame front irregularities, it is possible that the charges can go off out of order. The communication tubes are also small, so it is also possible the flame communication may be delayed to one or more charges, again causing the charges to go off out of order.

Therefore, a need exists for a new multiple report stun grenade that provides reduced likelihood of cross-contamination of pressure gradients causing sympathetic communication between explosion events. In this regard, the various embodiments of the present invention substantially fulfill at least some of these needs. In this respect, the multiple-report stun grenade according to the present invention substantially departs from the conventional concepts and designs of the prior art, and in doing so provides an apparatus primarily developed for the purpose of reducing the likelihood of cross-contamination of pressure gradients causing sympathetic communication between explosion events.

SUMMARY OF THE INVENTION

The present invention provides an improved multiple report stun grenade, and overcomes the above-mentioned disadvantages and drawbacks of the prior art. As such, the general purpose of the present invention, which will be described subsequently in greater detail, is to provide an improved multiple report stun grenade that has all the advantages of the prior art mentioned above.

To attain this, the preferred embodiment of the present invention essentially comprises an elongated body defining a body axis and having a sidewall and opposed top and bottom end faces, the body including a plurality of delay chambers each containing a different delay feature, the body having a plurality of flash charge chambers each containing a quantity of flash charge material, the body defining a plurality of ignition passages, each ignition passage individually communicating from a respective flash charge chamber to an associated delay chamber, each flash charge chamber having at least one exhaust aperture, and each of the exhaust apertures penetrating at least one of the top and bottom end faces. Each of the flash charge chambers may have a first exhaust aperture penetrating the top end face, and a second exhaust aperture penetrating the bottom end face. Each of the flash charge chambers may be an elongated bore parallel to the body axis. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
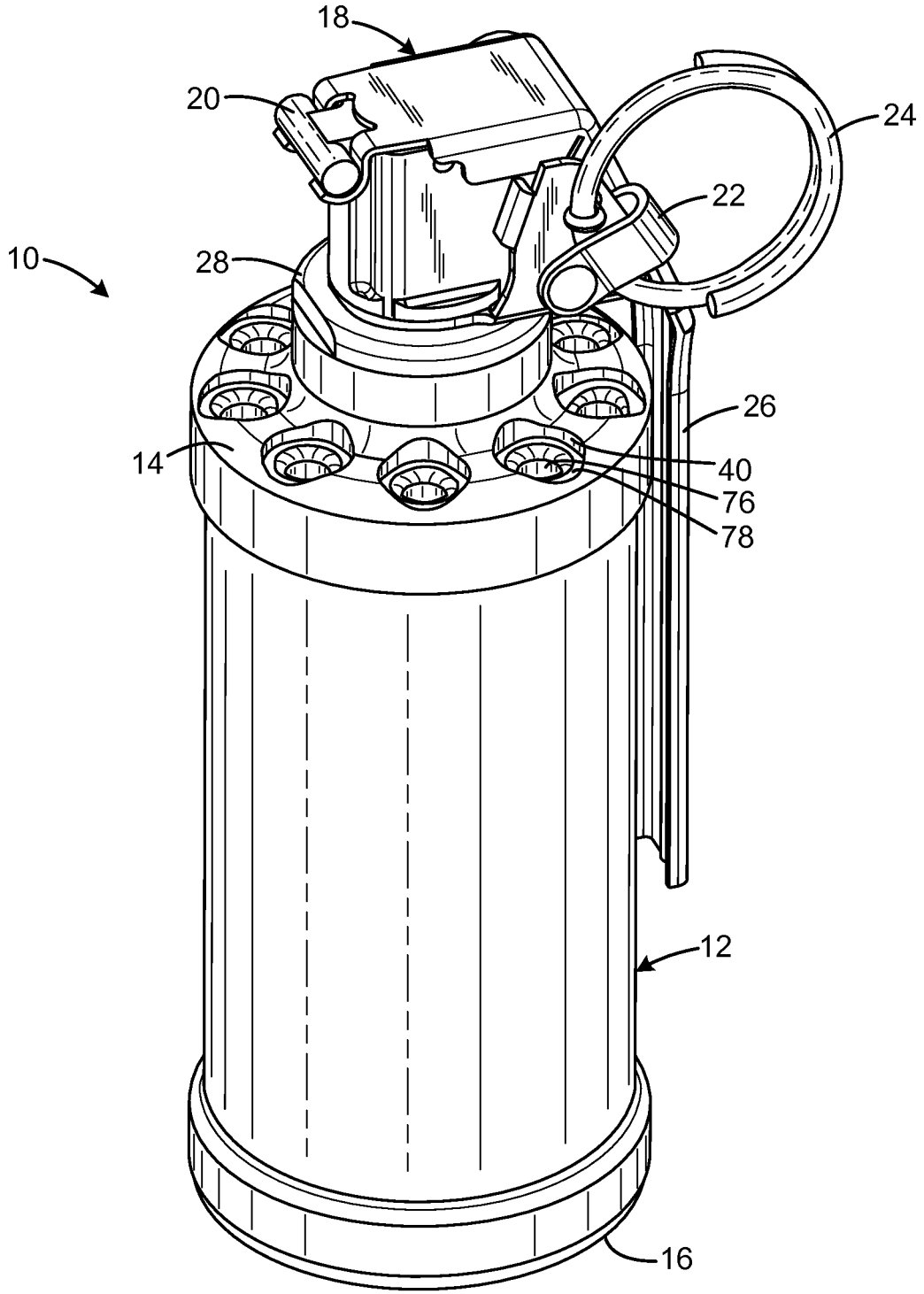
FIG. 1 is a top isometric view of the current embodiment of the multiple report stun grenade constructed in accordance with the principles of the present invention.

An embodiment of the multiple report stun grenade of the present invention is shown and generally designated by the reference numeral 10.

Figure 2:
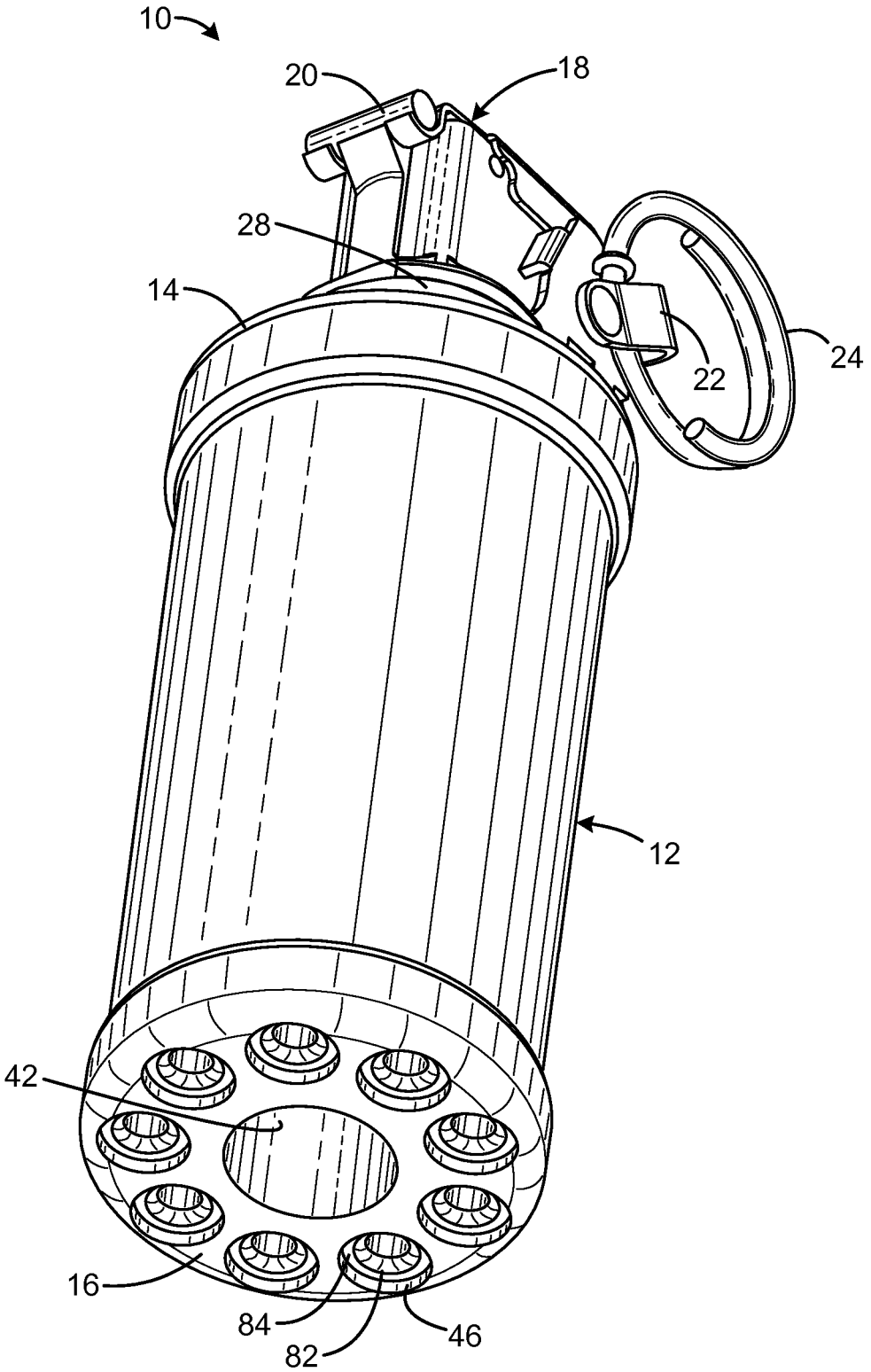
FIG. 2 is a bottom isometric view of the current embodiment of the multiple report stun grenade of FIG. 1.
Figure 3:
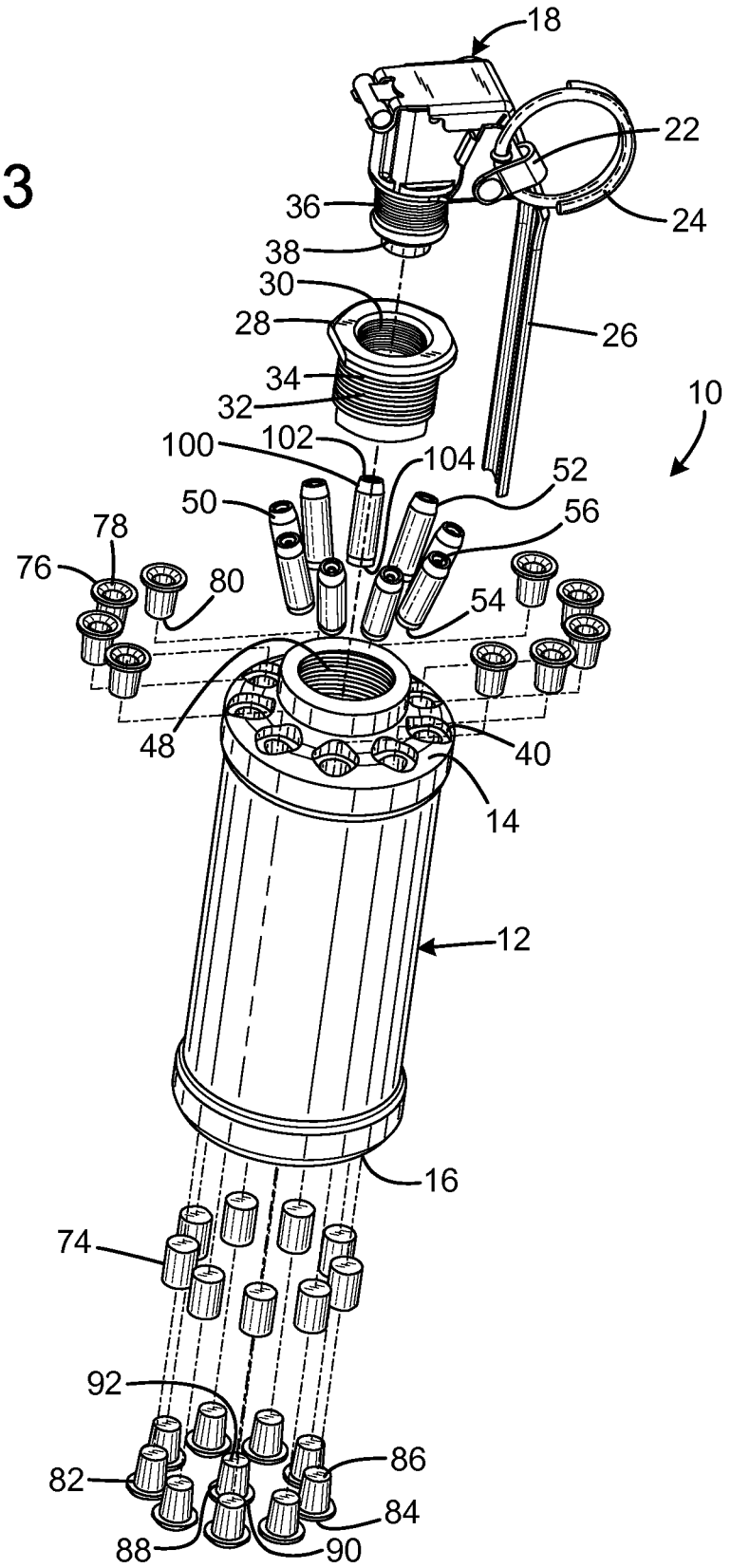
FIG. 3 is an exploded view of the current embodiment of the multiple report stun grenade of FIG. 1.
Figure 4:
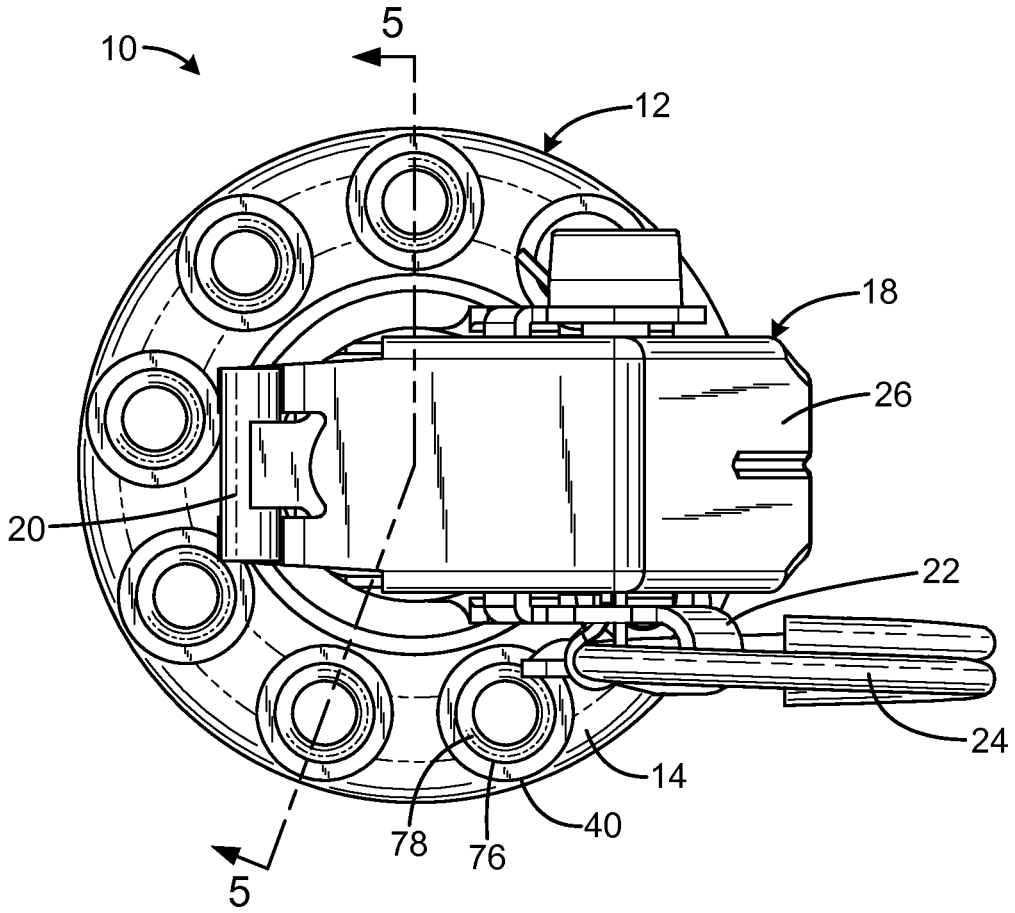
FIG. 4 is a top view of the current embodiment of the multiple report stun grenade of FIG. 1.
Figure 5:
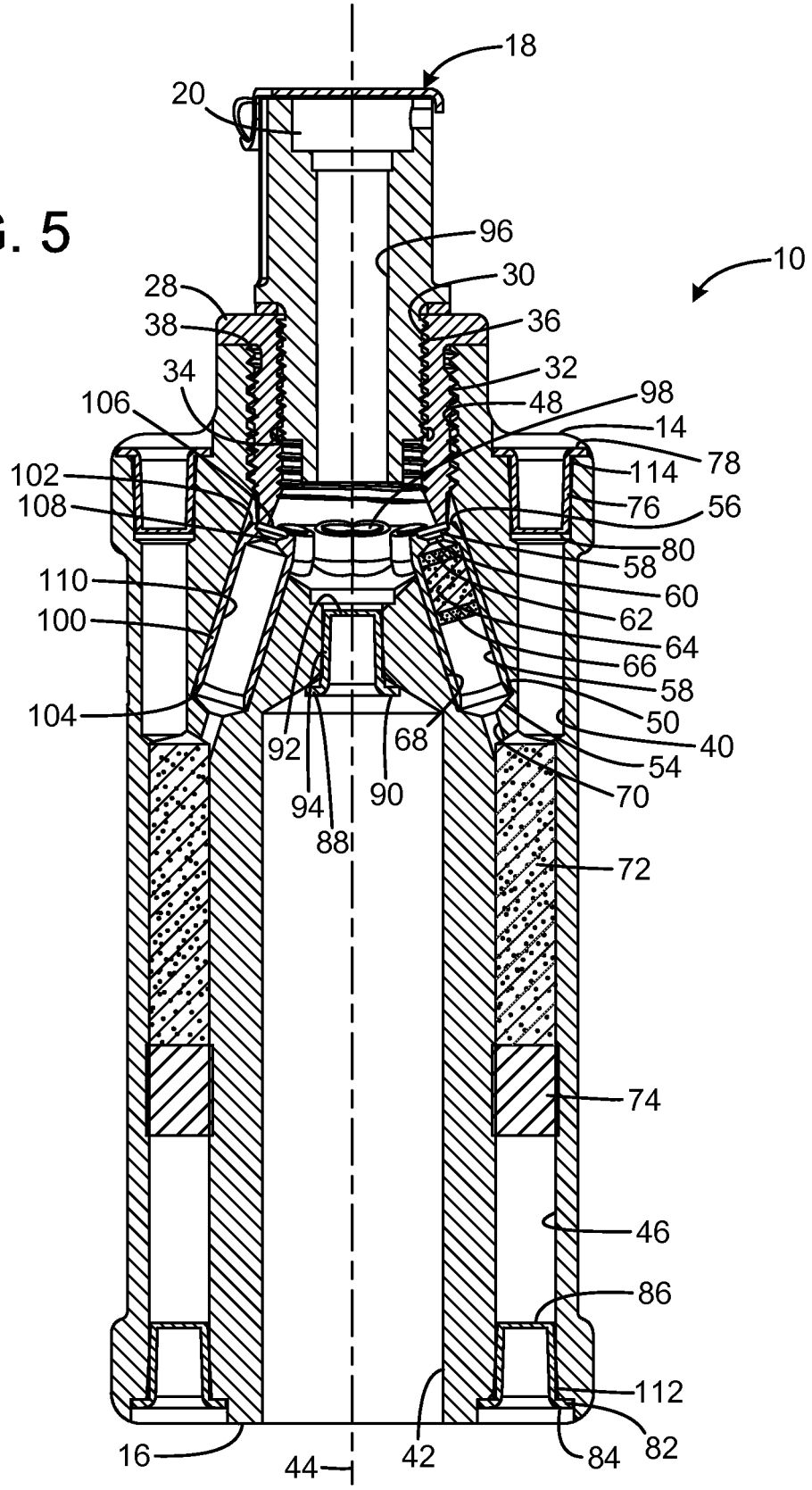
FIG. 5 is a sectional view of the current embodiment of the multiple report stun grenade of FIG. 1 taken along line 5-5 of FIG. 4.

FIGS. 1-5 illustrate the improved multiple report stun grenade 10 of the present invention. More particularly, the multiple report stun grenade has a cylindrical body 12 with a top end face 14 and a bottom end face 16. A fuse assembly 18 protrudes from the top end face and includes a safety clip 22 with connected extraction ring 24 and a spring-loaded paddle 26 that initiates a discharge sequence when the paddle is released after the extraction ring is removed.

The body 12 is a straight cylindrical body formed of a monolithic unitary block of material that is robust, machinable, and pyrotechnically nonreactive. In the preferred embodiment, it is formed from steel bar stock, with the features being formed by machining It is preferably machined by conventional means from a single unitary work piece, providing simplicity and economy of manufacturing. All the bores are open at both ends to the exterior of the body so conventional boring operations may be used, and all other machined passages open to at least one end to facilitate machining In alternative embodiments, the frame may be made from any rigid, durable, heat and fire resistant material such as certain ceramics, plastics, resins, and a wide variety of metals.

The body 12 essentially defines the finished dimensions of the stun grenade. It is sized to be handheld, with a diameter that provides for a secure grip. A diameter of 1.0-4.0 inch may be considered suitable for certain applications, while a diameter of 1.25-2.0 inch is preferred. The frame length is sized to provide an adequate grip and to ensure that the end faces are exposed when gripped by someone with large hands. A length of at least 3 inch is needed, and at least about 3.75 inch is preferred.

The body 12 has a central bore 42 sharing the axis 44 of the body having an internally threaded entrance 48 at the top and face 14. The threaded entrance is configured to receive the fuse assembly 18 after the fuse assembly is coupled to a thread adapter 28. The central bore continues all the way through the body and opens at the bottom face 16. The fuse assembly has a central bore 96 that enables the fuse 20 to communicate with the central bore 42 of the body.

The body 12 defines nine evenly spaced cylindrical upper bores 40 about the perimeter of the top end face 14 and nine evenly spaced cylindrical lower bores 46 about the perimeter of the bottom end face 16. In alternative embodiments, any number of upper and lower bores may be provided. The upper bores run parallel to each other and to the axis 40 and are spaced with rotational symmetry about the axis. The lower bores run parallel to each other and to the axis and are spaced with rotational symmetry about the axis.

The upper and lower bore diameters are all sized to accept the same environmental seal (sealing plugs 76, 82), so the uppermost portion of the upper bores and the lower bores are identical. To accommodate the fuse assembly 18 and other elements located at the top end face of the body, the upper bores typically have smaller diameters below the portion that receives the sealing plugs 76 and are positioned radially further away from the body's axis then are the lower bores. However, each of the upper bores communicates with an associated lower bore to form a tube with opposed open ends.

The body 12 includes nine delay bores 68, one for each pair of upper and lower bores 40, 46. Each delay bore extends from the portion of the central bore 42 located below the thread adapter 28 to an associated tubular passage 70 that communicates with an uppermost portion of an associated lower bore. The delay bores are positioned at angles extending downward and outward, collectively forming a conical pattern. The purpose of the geometry of the delay bores is to communicate between the central bore 42 at the top end face 14 of the body and the radially and axially remote intermediate points of the passages 70.

Each of the lower bores 46 is partially filled with a flash charge 72, typically a powdered metal fuel with an oxidizer, which generates the desired flash and bang or other pyrotechnic result. Each of the lower bores receives a plug 74 secures the associated flash charge against the uppermost portion of each lower bore.

Each of the angled delay bores 68 receives an associated delay tube 50, 100. The delay tubes all have identical structures, including a central bore 56, 110 extending from the top 52, 102 to the bottom 54, 104. Each of the central bores defines a small counterbore 58, 106 with a narrow hole 60, 108 where the central bore opens at the top. The central bore opens at the bottom in communication with an associated passage 70.

Each of the delay tubes 50 is filled with a different quantity of delay compounds that provide a selected delay duration. The delay duration results from the burn rate of the delay compounds contained within each delay tube as well as the mechanical length of the delay compounds within each delay tube. The small counterbores 58, 106 are coated with a priming paste 98, which is a pourable pyrotechnic compound that ensures ignition of the delay compounds through the small holes 60, 108. The priming paste 98, which is a slurry of nitrocellulose and black powder in the current embodiment, is ignited by a spark originating from the discharge of the fuse 20. The spark has traveled down the central bore 96 of the fuse assembly and into the uppermost portion of the central bore 42, where the spark simultaneously ignites all of the priming paste. Flame resulting from the ignition of the priming paste passes downward into the central bores of the delay tubes to simultaneously ignite the delay compounds, except for delay tube 100. Delay tube 100 is a special case where the central bore 110 is empty to impart no delay to the flame resulting from the ignition of the priming paste reaching and igniting the associated flash charge 72.

The first delay compound closest to the top of each delay tube 50 is a highly reactive first fire material 62 (FFFg black powder in the current embodiment, which has a fine granulation and burns rapidly) that readily ignites responsive to ignition of the priming paste. The delay composition 64 (made of zirconium-nickel in the current embodiment) has a desired composition and mechanical length to provide the selected delay duration. A layer of ignition material 66 (Titanium and Potassium Perchlorate igniter in the current embodiment) is located immediately below the delay composition. The ignition material generates adequate energy to reliably ignite the associated flash charge 72 in the associated lower bore 46. The ignition material is a dry, finely milled powder that is consolidated into a solid in the delay tube with a pneumatic piston. All of the material inside the delay tubes is installed this way.

The varying lengths of delay composition 64 provides a timed sequence of activating flash charges 72 in each lower bore 46. The lengths of delay composition can vary widely depending on the application, with the length variation being irregular to provide more random sounding bangs or varying by a consistent amount to provide a series of reports separated by the same interval. Or, the lengths may be the same or nearly the same, so that a simultaneous or simultaneous sounding report is heard.

The upper bores 40 and lower bores 46 are open on the ends to ensure the only escape of gases and materials upon discharge is via them being expelled axially. The provision of substantially equalized venting at both ends of the body 12 means the motive forces generated by expelled gases will be balanced. As a result, the stun grenade 10 tends to remain stationary where it was discharged instead of moving unpredictably as the flash charges 72 sequentially discharge. The axial venting of the upper and lower bores enables the body 12 to provide a safe barrier against injury even if the stun grenade were discharged in the user's hand. The body remains intact both during and after use of the stun grenade.

The delay tubes 50, 100 are made of brass in the current embodiment. The tubes lack sufficient strength to withstand the charges. As a result, each tube is vulnerable to being breached by its respective charge 72, enabling flame to progress back up the delay bore 68 and cause a sympathetic detonation of another charge. To prevent this, the delay tubes 50, 100 communicate via the passages 70 with an intermediate point of the tubes formed by the upper and lower bores. This not only allows for top and bottom venting as previously described, but also enhances reliability by reducing the likelihood of cross-contamination of pressure gradients causing sympathetic communication between explosion events. The small holes 60, 108 at the top of the delay tubes also provide a constricted passage or choke to prevent reverse flow of combustion gasses from a firing charge.

Assembly of the stun grenade 10 occurs first by inserting plugs 74 to a desired depth within the lower bores 46 and capping the opening of the lower bores at the bottom end face 16 of the body 12 with lower sealing plugs 82. The tops 84 of the lower sealing plugs seal the lower bore openings and the bottoms 86 of the lower sealing plugs are secured within the lower bores by a layer of adhesive 112. Then, the lower bores are filled with a desired quantity of flash charge material 72 via the upper bores 40, and the openings of the upper bores at the top end face 14 of the body 12 are capped with upper sealing plugs 76. The tops 78 of the upper sealing plugs seal the upper bore openings and the bottoms 80 of the lower sealing plugs are secured within the lower bores by a layer of adhesive 114. In the current embodiment, the adhesive 112, 114 is a high viscosity, rubber-toughened ethyl cyanoacrylate adhesive such as Apollo 2240-50 adhesive manufactured by Cyberbond LLC of Batavia, Ill., which is sufficiently strong to retain the sealing plugs within the upper and lower bores, but weak enough to enable the sealing plugs to be pushed out of the upper and lower bores by the pressure generated by ignition of the flash charges 72. In the current embodiment, the sealing plugs are made of plastic.

Subsequently, the delay tubes 50, 100 are pressed into the delay bores 68, and the bottom 92 of a center sealing plug 88 is pressed into the narrow portion 94 of the central bore 42 of the body 12 so the top 90 of the center sealing plug seals the narrow portion. The center sealing plug provides an environmental seal.

The final assembly steps to ready the stun grenade 10 for deployment are screwing the threaded portion 36 of the fuse assembly 18 into the threaded central bore 30 of the thread adapter 28 and subsequently screwing the threaded portion 32 of the thread adapter into the threaded entrance 48 of the body 12. A layer of epoxy 38 or other suitable adhesive secures the threaded portion 36 within the threaded central bore 30. A layer of epoxy 34 or other suitable adhesive secures the threaded portion 32 within the threaded entrance 48.

While a current embodiment of a multiple report stun grenade has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, the configuration need not be cylindrical, with the tubes formed by the upper and lower bores arranged in a circle. The configuration may be any contiguous array, including linear, or may be concentric rings of bores. It is preferred that each tube have axially opposed openings so the released gases are generally opposed and balanced. However, where this is not a concern, the principles of the current invention may be applied to single-exit versions of the tubes.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A stun grenade device comprising:

an elongated body defining a body axis and having a sidewall and opposed top and bottom end faces;

the body defining a plurality of delay chambers each having a different delay feature;

the body defining a plurality of flash charge chambers each containing a quantity of flash charge material;

the body defining a plurality of ignition passages, each ignition passage communicating from a respective delay chamber to an associated flash charge chamber;

each flash charge chamber having at least one exhaust aperture; and each of the exhaust apertures penetrating at least one of the top and bottom end faces.

2. The device of claim 1 wherein each of the flash charge chambers has a first exhaust aperture penetrating the top end face, and a second exhaust aperture penetrating the bottom end face.

3. The device of claim 1 wherein each of the flash charge chambers is an elongated bore parallel to the body axis.

4. The device of claim 1 wherein the flash charge chambers are arranged in a contiguous array.

5. The device of claim 1 wherein each delay chamber is an elongated bore communicating with a central bore in the body to a fuse at the top end face, the central bore being centered on the body axis.

6. The device of claim 1 wherein at least some of the delay features have different burn rates, such that a flame front in the delay chambers reaches some of the ignition passages at different times.

7. The device of claim 1 wherein the delay chambers are bores offset at an angle to the body axis.

8. The device of claim 1 wherein the flash charge chambers are arranged in a cylindrical array.

9. The device of claim 1 wherein the ignition passages are bores offset at an angle to the body axis.

10. The device of claim 9 wherein the ignition passages connect with an intermediate position between opposed open ends of the flash charge chambers.

11. The device of claim 10 wherein the intermediate position between opposed open ends of the flash charge chambers where the ignition passages connect is the same position along the length of each flash charge chamber.

12. The device of claim 5 wherein the central bore has a first aperture penetrating the top end face that receives a fuse assembly and a second exhaust aperture penetrating the bottom end face.

13. The device of claim 12 wherein the second exhaust aperture receives a plug that ejects via the second exhaust aperture responsive to a selected pressure accumulating within the central bore.

14. The device of claim 1 wherein the at least one exhaust aperture of each flash charge chamber receives a plug that ejects via the at least one exhaust aperture response to a selected pressure accumulating within the flash charge chamber.

15. The device of claim 1 wherein each delay chamber defines a counterbore with a constricted passage that communicates with the central bore in the body.

16. The device of claim 6 wherein the delay features have different burn rates because the delay features have different mechanical lengths.

17. The device of claim 1 wherein the sidewall is free of penetrations communicating with any of the flash charge chambers.

18. The device of claim 1 wherein the body defines a common ignition chamber communicating with each of the delay chambers.

* * * * *